United States Patent [19]

Ito et al.

[11] 4,299,908

[45] Nov. 10, 1981

[54] METHOD FOR FORMING A NEGATIVE IMAGE

[75] Inventors: Noboru Ito; Eiichi Sakamoto; Mikio Kawasaki; Takashi Uchida, all of Hino, Japan

[73] Assignee: Konishiroku Photo Industry Co., Ltd., Tokyo, Japan

[21] Appl. No.: 138,934

[22] Filed: Apr. 10, 1980

[30] Foreign Application Priority Data

Apr. 13, 1979 [JP] Japan ..... 54-5682

[51] Int. Cl.[3] ..... G03C 5/54

[52] U.S. Cl. ..... 430/244; 430/247; 430/251; 430/227; 430/234

[58] Field of Search ..... 430/202, 227, 234, 230, 430/244, 251, 415, 416

[56] References Cited

U.S. PATENT DOCUMENTS 3,615,438 10/1971 Land ..... 430/251

FOREIGN PATENT DOCUMENTS 1149922 4/1969 United Kingdom ..... 430/251

*Primary Examiner*—Won H. Louie, Jr.

*Attorney, Agent, or Firm*—Bierman & Bierman

[57] ABSTRACT

A method for forming a negative image comprising imagewise exposing a photographic material to provide exposed areas and unexposed areas, said material comprising, on a support, (1) an emulsion layer containing a light-sensitive silver halide, (2) unsensitized silver halide metallic salt grains which are more soluble in a developer than the light sensitive silver halide, and (3) nuclei for physical development, processing said material in the presence of a reducing agent and a solvent for said grains with said developer containing a substance which renders said grains less soluble by adsorbing thereto, said developer rendering said grains in said exposed areas and not in said unexposed areas soluble in said solvent, whereby metal ions are released and deposited on said nuclei.

10 Claims, No Drawings

METHOD FOR FORMING A NEGATIVE IMAGE

This invention relates to a method to form a negative image with high sensitivity, high contrast and high maximum density by utilizing smaller amount of light-sensitive silver halide than conventional method, and particularly relates to a method utilizing a metallic salt and nuclei for physical development.

There have been known a silver salt diffusion transfer process utilizing nuclei for physical development. With the process, the covering power of transferred image is very high and therefore the photographic image with higher density is obtained with a small amount of silver halide and the said process is known as an extremely useful image forming method because it gives an excellent sensitivity and sharpness.

However, this method gives finally a positive image but not a negative image.

A diffusion transfer process using a processing solution containing an insolubilizer and being able to form insoluble complex compound with silver halide in the development, is proposed in British Pat. No. 1,149,922, but by which method a satisfactory negative image is not obtained.

A photographic material containing internal latent image type silver halide grains having been fogged and surface latent image type silver halide grains containing silver iodide and not having been fogged is disclosed in U.S. Pat. Nos. 2,996,382 and 3,178,282.

However, with the said method, considerable reduction of the amount of silver is impossible and losses of the sensitivity are brought about because the internal latent image type silver halide grains have been fogged.

An object of the present invention is to offer a silver-saved silver halide photographic light-sensitive material from which a negative image with high sensitivity, high contrast and high maximum density is obtained.

Another object is to offer the high sensitive silver halide photographic material that has a high aptitude for a rapid processing at high temperature.

The other object is to offer the image forming method to intensify the contrast of image from a silver halide emulsion.

Other objects may be apparent from the description mentioned later.

The present inventors found that the above-mentioned objects are attained by a method shown as follows.

This method comprises an imagewise exposing and processing a photographic material comprising on a support, (1) a light sensitive silver halide, (2) a metallic salt grain which is more soluble in a developer than the light sensitive silver halide, and (3) nuclei for physical development.

The processing is effected by using the developer containing a substance which makes the metallic salt grain less soluble by absorbing to the metal salt grain in the presence of a reducing agent and a solvent for the metallic salt grain. By the processing, the said metallic salt grain in the exposed area is selectively dissolved and then deposited on physical development nuclei as a metal.

In the present invention a matter of significance is a solubility in a developer actually used. Experimentally the solubility is measured by means of a model developer, example of which is as following:

| | |
|---|---|
| Hydroquinone | 10 g |
| Sodium sulfite anhydride | 60 g |
| Sodium carbonate monohydrate | 20 g |
| Sodium thiosulfate pentahydrate | 4 g |
| Water to make | 1.0 l |

Light-sensitive silver halide to be used in the present invention includes silver chloride, silver bromide, silver iodide, silver chlorobromide, silver iodobromide, silver chloroiodobromide, and preferably, high sensitive silver iodobromide is to be used, and especially, silver iodobromide containing not more than 50 mol % of silver iodide, which bears iodine ion that recovers the solubility of insolubilized metallic grains, is suitable for the invention. And, photographic emulsion containing silver halide to be used in the invention is prepared by an ordinary method. And the silver halide grain of the light sensitive silver halide emulsion include those having a variety of crystal habits. Their average size is about 0.5 to 2.0$\mu$.

This silver halide emulsion can be sensitized by means of various types of sensitizers, and may be broaden its spectral sensitivity by using a sensitizing dye in order to give sensitivity in a desirable spectral bend, and can further be stabilized by various types of stabilizers.

This silver halide emulsion may be coated on a support to form a layer. Methods, for example, described in Research Disclosure RD-9232 (Dec. 1971) and RD-17643 (Dec. 1978) are applicable to the present invention.

Metallic salt grains to be used in the present invention is more soluble in a processor than the said light-sensitive silver halide. The solubility of the metallic salt grain is more than 5 times, preferably 10 times up to 10,000 times as much as that of the light-sensitive silver halide. The metallic salt grains preferably does not have substantial light-sensitivity. Wherein, the words, "not having light-sensitivity substantially" mean, when the material is developed after exposure while the light sensitive silver halide emulsion layer has enough density to form an image, the metallic grains have no other density than a fog.

The metallic salt grains are dispersed in a colloidal polymer solution, such as gelatine solution, and coated on support to form a layer.

And, metallic ion or metallic complex ion, which is produced as a result of that the metallic salt grains are dissolved, is reduced to metal on physical developing nuclei, in existence of reducing agent.

Metallic salt grains are appropriately selected from those having such nature as mentioned above, and a preferable example of the said metallic salt grains are silver halide grains not having sensitized. Further preferably the said silver halide grains have faster speed to be dissolved by processor than that of the said light-sensitive silver halide grains. Further concretely, metallic salt grains to be used preferably are silver bromide, silver chloride or silver bromochloride, which are not treated with chemical sensitizing process, and they are desirably of smaller grain size than those of the said light-sensitive silver halide, preferable grain size being 0.01 to 0.2$\mu$, and those metallic salt grains are used within the range of 0.01–100 mol (preferably 1–100 mol) of them to 1 mol of light-sensitive silver halide.

According to one of preferable embodiment of the present invention, sensitized silver iodobromide containing 50 mol or less of silver iodide is used as light-sensitive silver halide, and that not sensitized silver chloride is used as metallic salt grains, at a rate within the range between 0.01 mol and 100 mol per 1 mol of the sensitized silver iodobromide.

In a photographic material according to the present invention, the light sensitive silver halide, the metallic salt grain and the nuclei may be incorporated in a layer together in two layers, or three layers. One preferable embodiment of the two layers arrangement, a layer containing the light sensitive silver halide is coated on another layer containing the metallic salt grains and the nuclei coated on a support. Further the photographic material contains two elements, for example, a layer containing the nuclei is coated on a support to form an element and a layer or layers containing the light sensitive silver halide and the metallic salt grains on another support.

Supports used in conventional photographic are utilized for the purpose of the present invention. Examples of them include polyester, polyethylene and cellulose triacetate.

Nuclei for physical development of the present invention contain substance having a function to accelerate, as catalyst, the process that metallic ion or metallic complex ion produced by dissolving the said metallic salt grains, is reduced to metal by means of reducing agent, or the said nuclei contain a chemically active site having the said function. The coating amount of the nuclei for physical development is in a range of 0.0001–0.5 mg/100 $cm^2$. The nuclei may be coated after dispersed in a hydrophillic colloid such as gelatine.

As for a typical example of the above, colloids of metal or its sulfide concretely as the metal, gold, silver, palladium, cadmium, selenium, copper, zinc, mercury, and so on are given, and those physical developing nuclei are not always necessary to be grains in physical meaning.

Substance which makes metallic salt less soluble and amounts thereof are selected so as to reduce the solubility more than 10 times. The substance used for the present invention includes compounds of three types. One is a compound that makes the dissolving speed of the metal salt grain slower by adsorbing on at least a part of surfaces of the metallic salt grains, and another is a such compound that forms a hardly soluble salt or complex salt of the metal by adsorbing on surface of more soluble metallic salt grain, and the other is a compound forming a hardly soluble salt or complex salt with a metallic ion provided from dissolved metal salt.

According to a preferable embodiment of the present invention, a substance which makes metallic salt less soluble is selected from compounds including, for example, mercapto compounds, more concretely, cysteine, 1-phenyl-5-mercaptotetrazole, mercaptobenzthiazole, etc. as the typical concrete examples. And, thiourea, indazoles, triazoles, imidazoles, etc. are the preferable compounds enable to be used in the invention. The adding amount of the substance is preferably 10 mg/1–1.0 g/l per processing solution, and 50–500 mg/l is particularly preferable.

The reducing agent and the solvent for the metallic grains may be individually incorporated in a light sensitive material, or may be supplied from a processing solution at a developing process.

The reducing agent includes photographic developing agents, such as hydroquinone, 4-N-methylaminophenol, ascorbic acid, isoascorbic acid, 2,6-dimethyl-4-aminophenol, methylhydroquinone, 2,6-dimethylhydroquinone, 2-methyl-4-amino-6-methoxyphenol, 2,6-dimethoxy-4-aminophenol, 2,5-dimethylhydroquinone, 2,4,6-triaminophenol, 2,4-diaminophenol (amidol), N,N-diethylhydroxylamine and 4,6-diamino-orthocresol. The agent is preferably contained in a developer.

The solvent for the metallic salt grains used in the present invention may be contained in a processing solution, for instance, water. According to the most preferable embodiment of the invention, the said solvent is the one that does not substantially dissolve the light-sensitive silver halide, or is the one that dissolves metallic salt of which solubility is greater than that of the said light-sensitive silver halide, that is the said metallic salt particle, in adding with the said substance in such a quantity that light-sensitive silver halide is not substantially dissolved, as for the typical examples, sulfites such as sodium sulfite, etc., thiosulfates such as sodium thiosulfate, potassium thiosulfate, ammonium thiosulfate, etc., prussiates such as potassium cyanide, sodium cyanide, etc., thiocyanates such as sodium thiocyanate, ammonium rhodanate, etc., amino acid compounds such as cystine, cysteine, etc., thiourea compounds such as thiourea, phenylthiourea, 3,6-dithia-1,8-octadiol, etc., and thioether compounds, etc., are given.

The processing solution containing a substance which makes the metal salt grain less soluble may contain a reducing agent, solvent, pH buffering salt or alkali agent. The pH of the solution is in a range of 9.0–12.5, preferably 10.0–12.0. Processing temperature is in a range 20°–45° C.

An image obtained by such processing mentioned above is fixed by means of fixing bath, which is well known to a person skill in the art.

The following examples will explain the present invention more in detail.

EXAMPLE 1

Silver chloride gelatin emulsion is prepared by adding with 200 ml of water solution dissolved with 60 g of silver nitrate into 1 l of water solution dissolved with 20.65 g of sodium chloride and 10 g of gelatin all of which being stirred at 60° C. Next, the emulsion is dispersed in 800 ml of water solution dissolving 38 g of gelatin, after washing by a normal precipitating method.

Silver chloride emulsion thus obtained, high sensitive silver iodobromide emulsion containing 10 mol % of silver iodide, and physical developing nuclei, are coated on a film support with a variety of, as shown in Table 1, coating amount of silver to prepare the following samples:

Sample (A)

A sample containing high sensitive silver iodobrimide emulsion only.

Sample (B)

A sample containing silver chloride emulsion only.

Sample (C)

A sample arranging a layer containing high sensitive silver iodobromide emulsion coated on a layer containing the silver chloride emulsion only.

Sample (D)

A sample arranging a layer containing high sensitive silver iodobromide emulsion coated on a layer containing silver chloride emulsion and physical developing nuclei.

Sample

Thus obtained silver halide sensitized material is exposed at 3.2 CMS through an optical wedge and then is developed by a continuously transporting roller type automatic developing machine for 30 seconds at 35° C., wherein the composition of the developer is as follows:

| | |
|---|---|
| Hydroquinone | 10 g |
| 1-phenyl-1,3-pyrazolidone | 1.0 g |
| Sodium sulfite anhydrous | 60 g |
| Sodium carbonate monohydrate | 20 g |
| Sodium hydroxide | 10 g |
| Sodium thiosulfate (pentahydrate) | 4 g |
| 1-phenyl-5-mercaptotetrazole | 0.5 g |
| Add water to make | 1 l |

The table 1 illustrates the photographic characteristics of the samples. For reference, sensitivity of one of samples of (A) having the same coated amount of silver as the samples of the present invention, is regarded as 100, to which the sensitivities shown in the table represent the relative values.

TABLE 1

| | Coated amount of silver [g/m²] | | Photographic characteristics | | | | |
|---|---|---|---|---|---|---|---|
| Samples | Silver iodo-bromide | Silver chloride | Sensi-tivity | Fog | Gamma | Max. den-sity | |
| [A] | 0.3 | 0 | 5 | 0.01 | 0.02 | 0.30 | Comparison |
| | 3.3 | 0 | 100 | 0.22 | 0.60 | 1.24 | Comparison |
| [B] | 0 | 3.0 | — | 0.02 | — | 0.03 | Comparison |
| [C] | 0.3 | 3.0 | 5 | 0.20 | 0.05 | 0.65 | Comparison |
| | 1.3 | 2.0 | 30 | 0.14 | 0.50 | 1.02 | Comparison |
| [D] | 0.3 | 3.0 | 105 | 0.05 | 2.60 | 3.44 | The present invention |
| | 1.3 | 2.0 | 115 | 0.10 | 2.57 | 3.12 | The present invention |

As clearly shown in the table 1, according to the method of the invention, a negative image having sufficiently enough sensitivity and a maximum density is obtained in spite of the fact that an amount of silver is reduced. Further in the method of the invention, it is seemed that silver chloride is dissolved and then reduced to metal on nuclei for physical development.

EXAMPLE 2

Same silver chloride emulsion as prepared in the example 1, and high sensitive silver iodobromide emulsion are coated together onto paper support. Coating amount per 1 m² is so decided as 3.0 g in silver equivalent of silver chloride and 0.3 g in silver equivalent of high sensitive silver iodobromide.

Thus obtained samples are exposed through optical wedges. An image receiving layer which is coated with physical developing nuclei onto film base is superimposed face to face of emulsion of the exposed sample and the following developing solution layer spread into the gap between the both emulsion surfaces so as to make the thickness of about 0.006 cm.

| | |
|---|---|
| Water | 9.2 ml |
| Sodium carboxymethyl cellulose (midium viscosity) | 0.41 g |
| Sodium sulfite anhydrous | 0.3 g |

-continued

| | |
|---|---|
| Sodium hydroxide | 0.26 g |
| 1-phenyl-5-mercaptotetrazole | 0.005 g |
| Sodium thiosulfate ($5H_2O$) | 0.005 g |
| Amidol | 0.60 g |

Peeling off after three minutes, a negative image having high sensitivity, high gamma and high maximum density is obtained on the image receiving layer, similar to the one obtained in the sample (D) of the example 1.

EXAMPLE 3

A light sensitive element relating to the invention is prepared by making use of the same method as that of the example 2 (provided that high sensitive silver iodobromide emulsion is prepared according to the method of the example 21 of British Pat. No. 1,149,922, for comparison).

After exposure, similar to the example 1, onto the two samples thus obtained, development is practised using the image receiving element of the Polaroid Rand Film, Type 47. The same viscose developing solution as that of the example 2 is used, and after four minutes the said samples are peeled off. A negative image having the photographic characteristics shown below is obtained on an image receiving element thereby.

TABLE 2

| | Sensitivity | Fog | Gamma | Max. Density |
|---|---|---|---|---|
| The invention | 400 | 0.05 | 2.76 | 3.58 |
| The comparison sample | 100 | 0.05 | 1.56 | 2.51 |

As it is clear from the above table 2, the sample relating to the invention has high sensitivity, and a negative image having superb gamma and maximum density can be obtained as well.

What is claimed is:

1. A method for forming a negative image comprising imagewise exposing a photographic material to provide exposed areas and unexposed areas, said material comprising, on a support, (1) an emulsion layer containing a light-sensitive silver halide, (2) unsensitized silver halide metallic salt grains which are more soluble in a developer than the light sensitive silver halide, and (3) nuclei for physical development, processing said material in the presence of a reducing agent and a solvent for said grains with said developer containing a substance which renders said grains less soluble by adsorbing thereto, said developer rendering said grains in said exposed areas and not in said unexposed areas soluble in said solvent, whereby metal ions are released and deposited on said nuclei.

2. A method according to claim 1, wherein the developer contains the reducing agent.

3. A method according to claim 1, wherein the developer contains the solvent for the metallic salt grains.

4. A method according to claim 1, wherein the light sensitive silver halide is a silver iodobromide.

5. A method according to claim 1, wherein the light sensitive silver halide is a silver bromide.

6. A method according to claim 1, wherein the metallic salt grain is a silver chloride.

7. A method according to claim 1, wherein the metallic salt grain is incorporated in the emulsion layer.

8. A method according to claim 1 or 8, wherein the nuclei are incorporated in the emulsion layer.

9. A method according to claim 1, wherein the nuclei are incorporated in a layer coated on a support which layer is arranged between the support and the emulsion layer.

10. A method according to claim 9 wherein the metallic salt grain is incorporated in a layer which is arranged between the emulsion layer and the layer incorporated with the nuclei.

* * * * *